US007434495B2

(12) United States Patent
Lin

(10) Patent No.: US 7,434,495 B2
(45) Date of Patent: Oct. 14, 2008

(54) HAND TOOL WITH EXTENDABLE HANDLE

(76) Inventor: Yi-Ting Lin, No. 113, Lane 60, Gong-Jiew Street, Ta-Li City, Taichung County, Ta-Li (TW) 412

( * ) Notice: Subject to any disclaimer, the term of this patent is extended or adjusted under 35 U.S.C. 154(b) by 0 days.

(21) Appl. No.: 11/807,991

(22) Filed: May 30, 2007

(65) Prior Publication Data

US 2008/0148908 A1 Jun. 26, 2008

(51) Int. Cl.
*B25B 23/16* (2006.01)
*B25G 1/04* (2006.01)

(52) U.S. Cl. ..... 81/177.2; 403/109.3; 403/377; 16/429

(58) Field of Classification Search ..... 81/177.2; 16/429; 294/19.2; 403/109.1–109.3, 109.6, 403/109.8, 377, 379.2, 379.1, 379.5, 379.6
See application file for complete search history.

(56) References Cited

U.S. PATENT DOCUMENTS 2,438,633 A * 3/1948 Condor ..... 403/107
3,227,015 A * 1/1966 Tremblay ..... 81/177.2
5,109,737 A * 5/1992 Raber ..... 81/177.2
6,408,721 B1 * 6/2002 Lee ..... 81/177.2
6,761,094 B2 * 7/2004 Tobako ..... 81/177.2
7,066,676 B2 * 6/2006 Tsai ..... 403/109.3
2005/0123344 A1 * 6/2005 Bensussan ..... 403/109.2
2007/0012346 A1 * 1/2007 Choi ..... 403/109.1

* cited by examiner

*Primary Examiner*—D. S Meislin

(57) ABSTRACT

A hand tool includes a first part including a head and a shank. Three first holes are defined in the shank and each receive a first stop and a first spring therein. A second hole is defined in shank and located at an axis different from an axis of the first holes, a second stop and a second spring are received in the second hole. A second part is movably mounted to the shank and includes a positioning hole with which one of the first stop is removably engaged. The second stop is slidably engaged with a groove in the second part. A third part is mounted to the second part and includes button which is pushed to remove the first stop from the position hole so that the second part and the third part can be moved relative to the shank.

5 Claims, 4 Drawing Sheets

HAND TOOL WITH EXTENDABLE HANDLE

FIELD OF THE INVENTION

The present invention relates to a hand tool with an extendable handle which is slidable along the shank of the hand tool.

BACKGROUND OF THE INVENTION

A conventional hand tool generally includes a shank with a head on one end of the shank and a handle or grip on the other end of the shank. The handle or grip is fixed on the shank so that the length of the hand tool is fixed and cannot be changed. When tightening or loosening a tightly screwed object, a larger torque is needed, the conventional hand tool having a fixed length of shank has a fixed arm of force so that the maximum torque is set. The user has to find an extension rod to be connected with the hand tool to increase the length of the arm of force so as to easily apply a larger torque to the object. This means the extension rod should be prepared and a proper connection mechanism is required to both of the extension rod and the hand tool. Either of the two above mentioned requirements is not met, the user cannot have the longer arm of force.

The present invention intends to provide a hand tool which includes an extendable handle which can be positioned at two positions which are a normal position to have a shorter arm of force and an extended position to have a longer arm of force. No extra extension rod is needed.

SUMMARY OF THE INVENTION

The present invention relates to a hand tool which comprises a first part including a head and a shank and a plurality of first holes are defined in an outer periphery of the shank and each first hole receives a first stop and a first spring therein which keeps a part of the first stop to extend out from the first hole. A second hole is defined in the outer periphery of the shank and located at an axis different from an axis of the first holes. A second stop and a second spring are received in the second hole, and a part of the second stop extends out from the second hole.

A second part is movably mounted to the shank and includes a positioning hole and a third hole. One of the first stops is removably engaged with the positioning hole and the second stop is slidably engaged with a groove defined in an inner periphery of the second part. The third hole communicates with the groove and a third stop is engaged with the third hole so as to stop the second stop.

A third part includes a sleeve and a button, the sleeve is mounted to the second part and a control hole is defined through a wall of the sleeve and located in alignment with the positioning hole. The button is movably engaged with the control hole and pushes the first stop to disengage from the first hole to allow the second part and the third part to slide relative to the shank.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
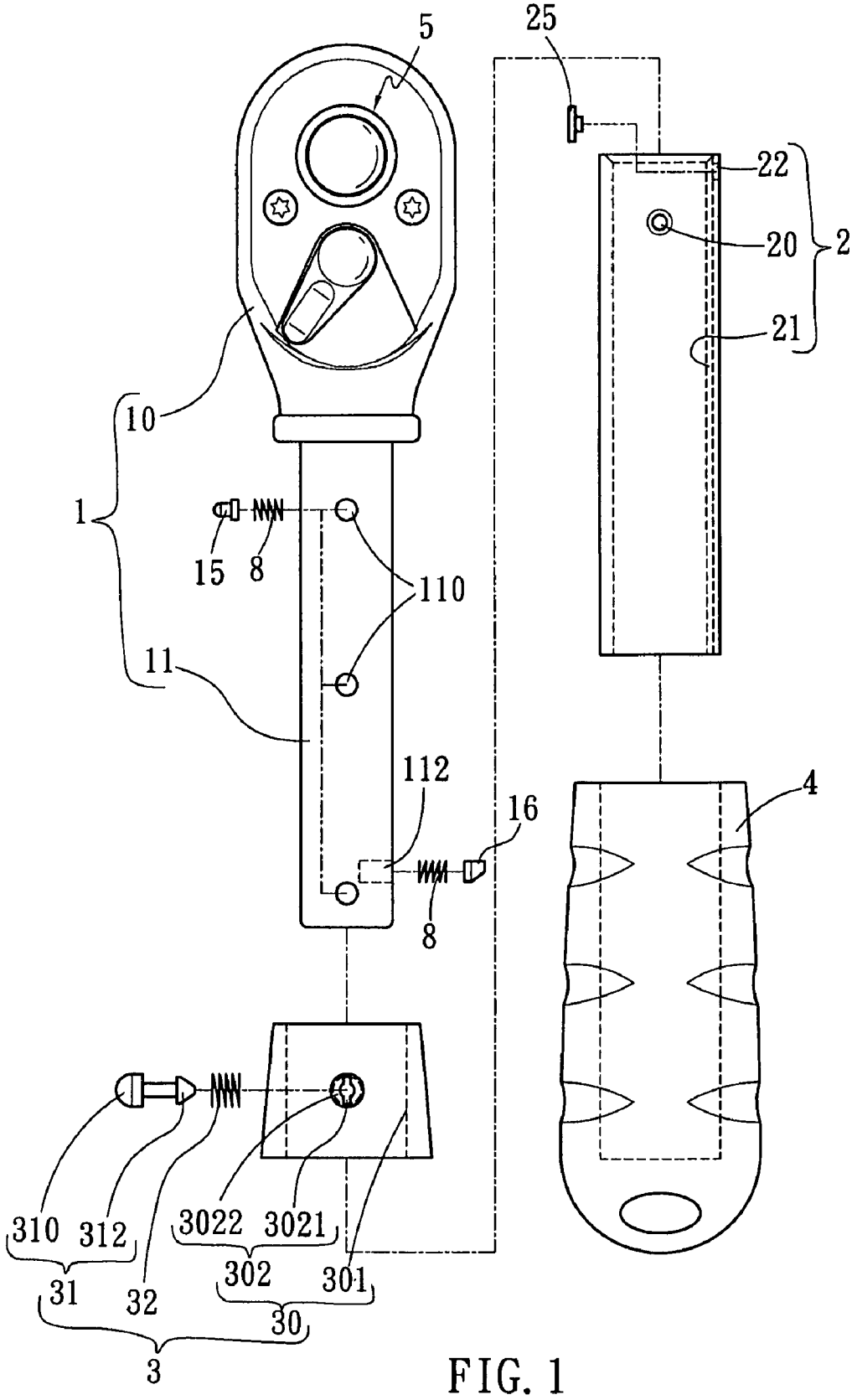
FIG. 1 is an exploded view to show the hand tool and the extendable handle of the present invention.
Figure 2:
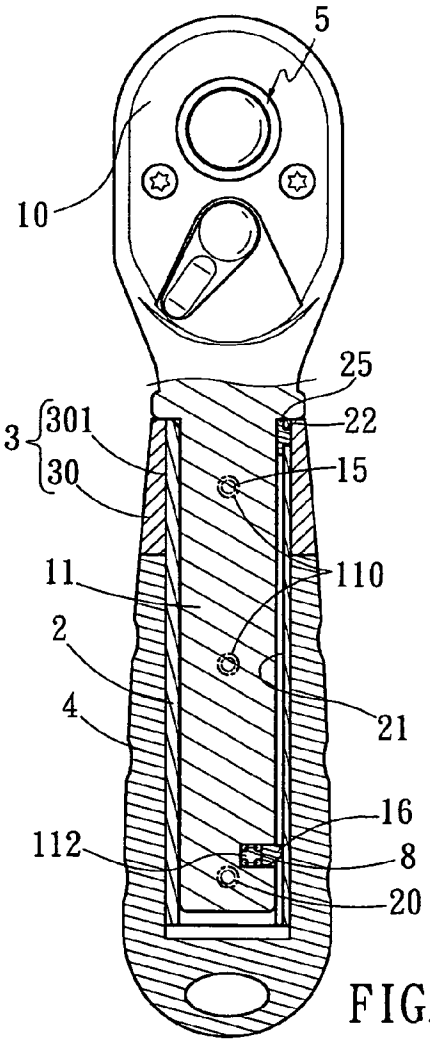
FIG. 2 is a cross sectional view to show the hand tool and the extendable handle of the present invention, wherein the second and third parts are not pulled relative to the first part.
Figure 3:
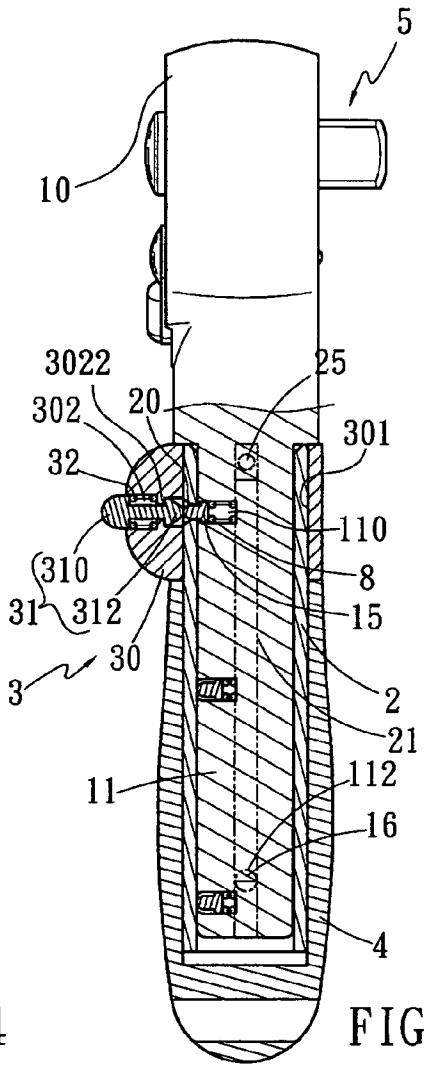
FIG. 3 is a side cross sectional view of FIG. 3.

Referring to FIGS. 1 to 3, the hand tool of the present invention comprises a first part 1 having a head 10 and a shank 11 which is connected to the head 10 which includes a ratchet mechanism 5 which is well known and will not be described. Three first holes 110 are defined in an outer periphery of the shank 11 and each first hole 110 receives a first stop 15 and a first spring 8 therein which keeps a part of the first stop 15 to extend out from the first hole 110. The three first holes 110 are located at the same axis of the shank 11. A second hole 112 is defined in the outer periphery of the shank 11 and located at an axis different from the axis of the first holes 110. A second stop 16 and a second spring 8 are received in the second hole 112. A part of the second stop 16 extends out from the second hole 112 and includes an inclined surface.

A second part 2 is movably mounted to the shank 11 and has a positioning hole 20 and a third hole 22 defined through a wall of the second part 2. One of the first stops 15 is removably engaged with the positioning hole 20 and the second stop 16 is slidably engaged with a groove 21 defined in an inner periphery of the second part 2. By the engagement of the second stop 16 and the groove 21, the second part 2 is slid linearly and does not rotate relative to the shank 11. The third hole 22 communicates with the groove 21 and a third stop 25 is engaged with the third hole 22 so as to stop the second stop 16 to prevent the shank 11 from dropping out from the second part 2.

A third part 3 includes a sleeve 30 and a button 31, wherein the sleeve 30 has a passage 301 defined axially therethrough and is mounted to the second part 2. A control hole 302 is defined through a wall of the sleeve 30 and located in alignment with the positioning hole 20. The control hole 302 includes a slot 3021 defined by two flanges 3022 extending inward from an inner periphery of the control hole 302. The button 31 is movably engaged with the control hole 302 and includes a tapered head 312 and an enlarged butt 310. A third spring 32 is biased between the tapered head 312 and the flanges 3022. A grip 4 is fixedly mounted to an outside of the second part 2.

Figure 4:
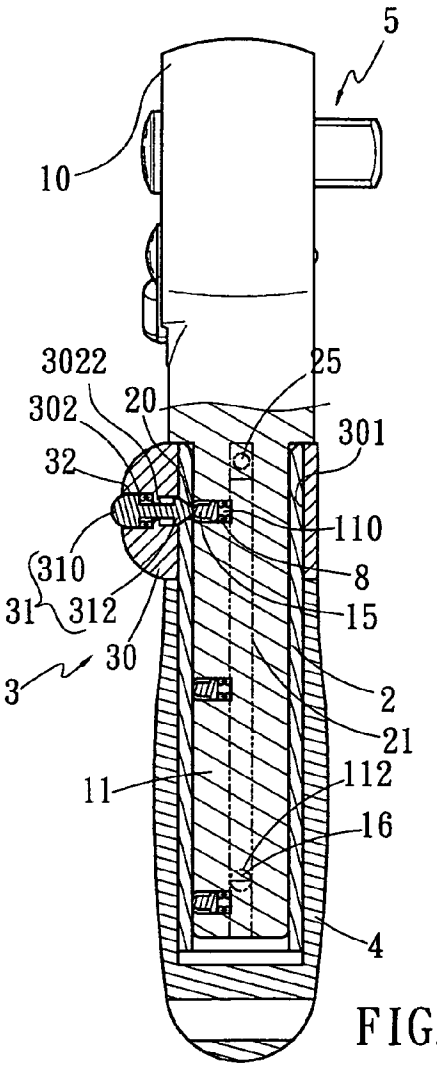
FIG. 4 shows the button is pushed to disengage from the first hole.
Figure 6:
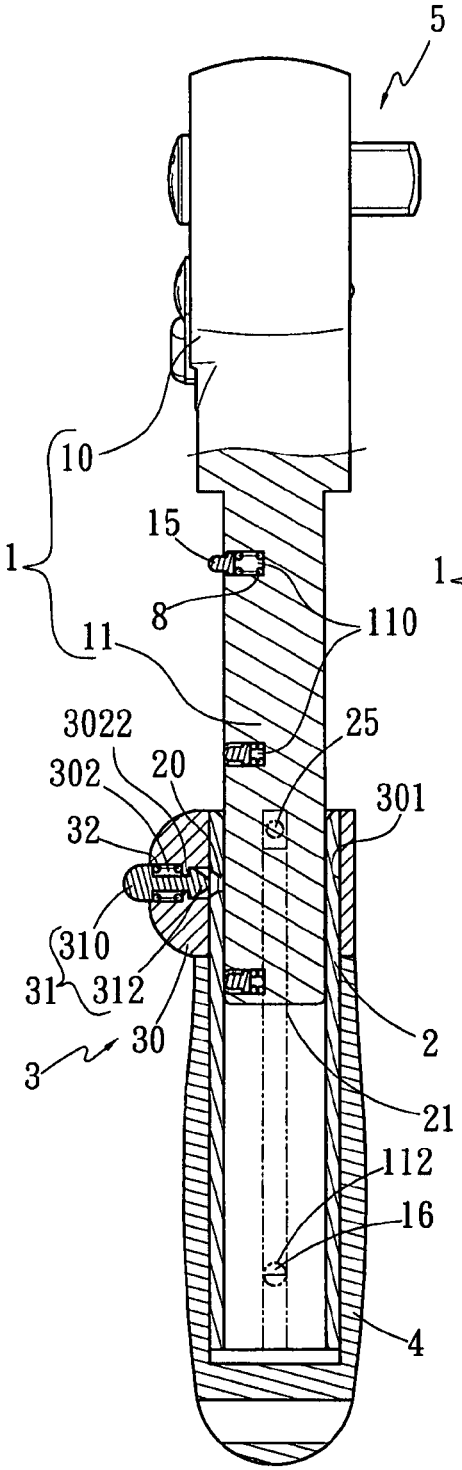
FIG. 6 is a side cross sectional view of FIG. 5.
Figure 5:
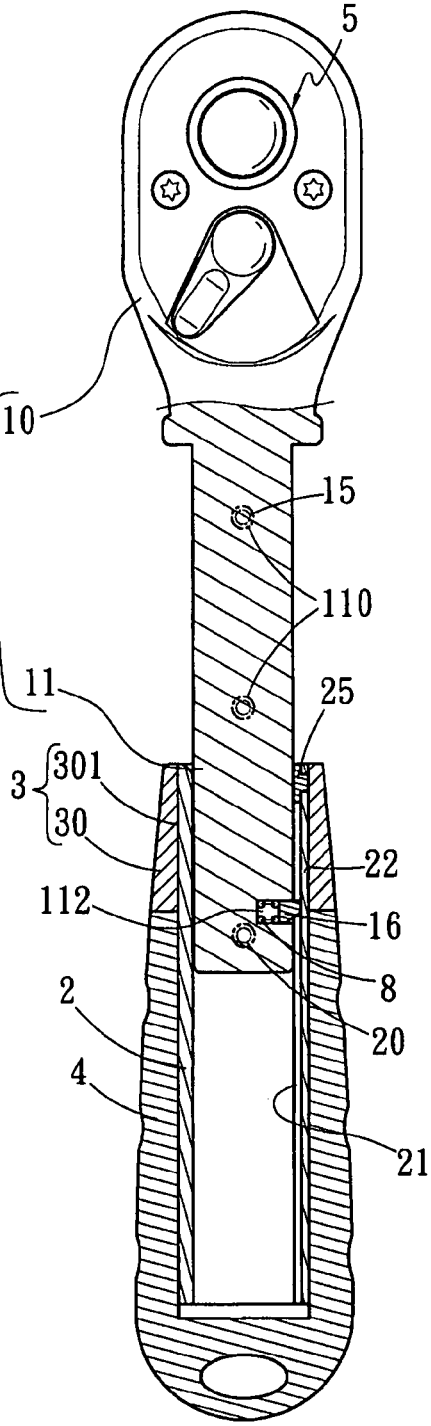
FIG. 5 shows the second and third parts are pulled relative to the first part.
Figure 8:
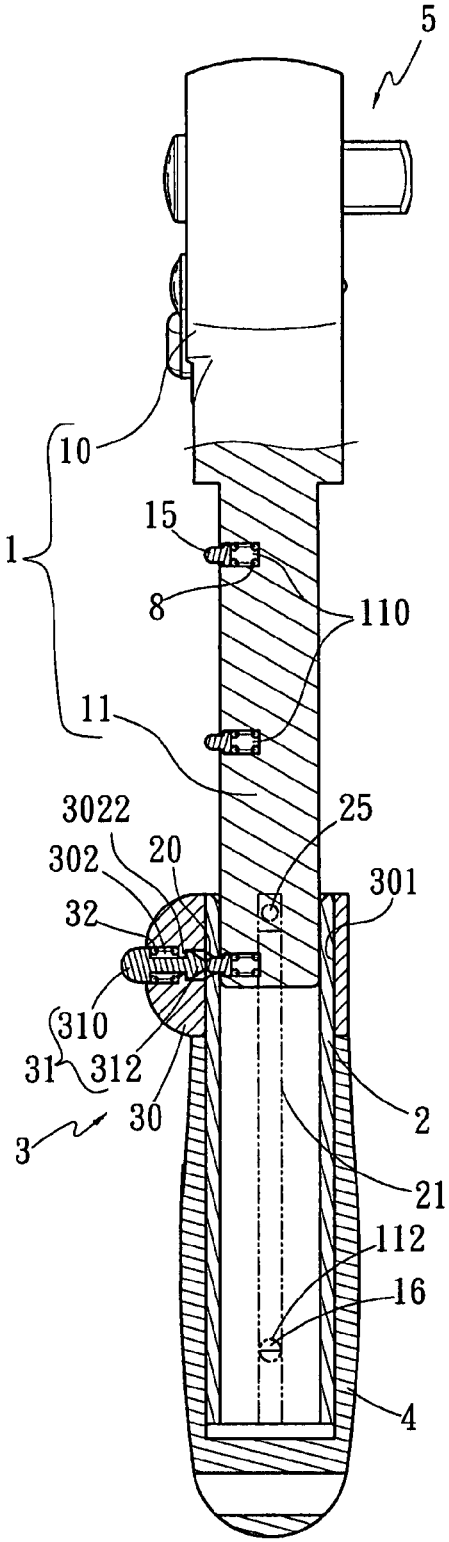
FIG. 8 is a side cross sectional view of FIG. 7.
Figure 7:
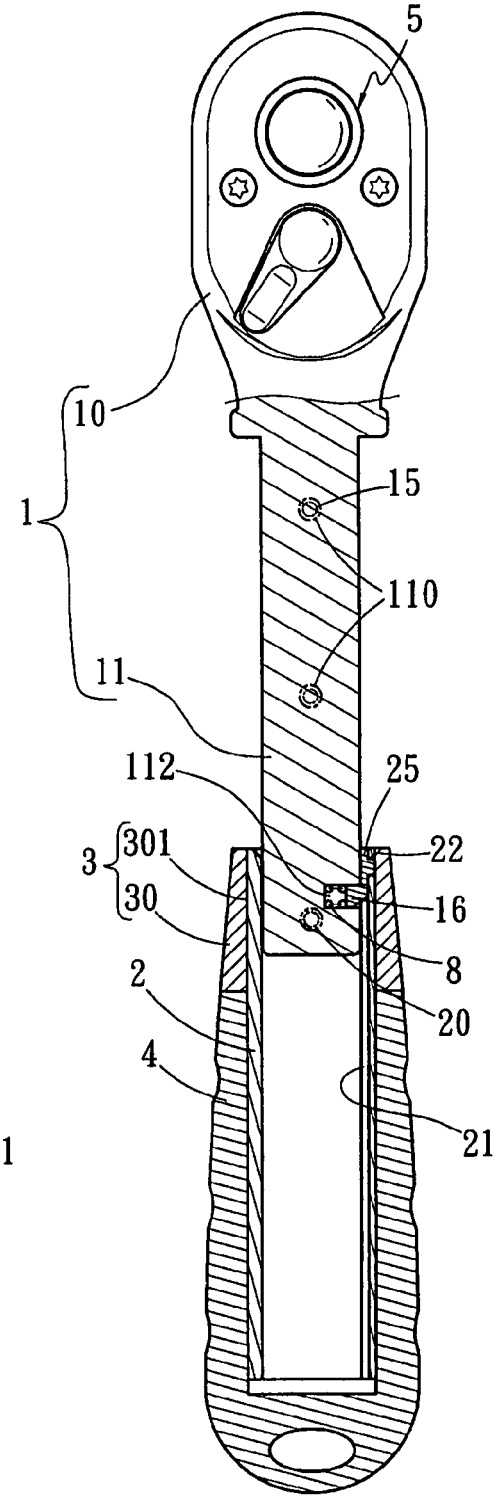
FIG. 7 shows the first stop of the lowest first hole is engaged with the positioning hole to set the second and third parts.

When pushing the first stop 15 inward as shown in FIG. 4, the tapered head 312 is squeezable to pass through the slot 3021 to push the first part 15 to disengage from the first hole 110 so that the second part 2 and the third part 3 together with the grip 4 can be slid relative to the shank 11 as shown in FIGS. 5 and 6.

The second part 2, the third part 3 and the grip 4 are slid relative to the shank 11 to a desired position where the first stop 15 in the lowest first hole 110 is engaged with the positioning hole 20 to set the second part 2. The button 31 is pushed by the third spring 32 and the tapered head 312 passes through the slot 3021 to the position as shown in FIG. 3.

The extendable handle for the hand tool of the present invention provide a compact structure and the length of the handle of the hand tool can be decided by the user according practical need. The number of the first holes 110 can be more than three to have a longer arm of force.

While we have shown and described the embodiment in accordance with the present invention, it should be clear to those skilled in the art that further embodiments may be made without departing from the scope of the present invention.

What is claimed is:

1. A hand tool comprising:

a first part having a head and a shank connected to the head, a plurality of first holes defined in an outer periphery of the shank and each first hole receiving a first stop and a first spring therein which keeps a part of the first stop to extend out from the first hole, a second hole defined in the outer periphery of the shank and located at an axis different from an axis of the first holes, a second stop and a second spring received in the second hole, a part of the second stop extending out from the second hole;

a second part movably mounted to the shank and having a positioning hole and a third hole defined through a wall of the second part, one of the first stops removably engaged with the positioning hole, the second stop slidably engaged with a groove defined in an inner periphery of the second part, the third hole communicating with the groove and a third stop engaged with the third hole so as to stop the second stop, and a third part including a sleeve and a button, the sleeve having a passage defined axially therethrough and mounted to the second part, a control hole defined through a wall of the sleeve and located in alignment with the positioning hole, the button movably engaged with the control hole and pushing the first stop to disengage from the first hole to allow the second part and the third part to slide relative to the shank.

2. The hand tool as claimed in claim 1, wherein the control hole includes a slot defined by two flanges extending inward from an inner periphery of the control hole, the button includes a tapered head and an enlarged butt, the tapered head is squeezable to pass through the slot.

3. The hand tool as claimed in claim 2, wherein a third spring is biased between the tapered head and the flanges.

4. The hand tool as claimed in claim 1, wherein the second stop includes an inclined surface.

5. The hand tool as claimed in claim 1, wherein a grip is fixedly mounted to an outside of the second part.

* * * * *